United States Patent [19]

Nishikawa

[11] Patent Number: 4,885,963

[45] Date of Patent: Dec. 12, 1989

[54] OSCILLATING DRIVE APPARATUS FOR WORKING TOOL AND WORKING APPARATUS USING THE SAME

[75] Inventor: Hideichi Nishikawa, Mie, Japan

[73] Assignee: MCC Corporation, Mie, Japan

[21] Appl. No.: 315,475

[22] Filed: Feb. 24, 1989

[30] Foreign Application Priority Data

| | | | |
|---|---|---|---|
| Feb. 26, 1988 | [JP] | Japan | 63-25710[U] |
| Sep. 29, 1988 | [JP] | Japan | 63-127557[U] |
| Oct. 11, 1988 | [JP] | Japan | 63-132490[U] |
| Oct. 11, 1988 | [JP] | Japan | 63-132491[U] |
| Dec. 19, 1988 | [JP] | Japan | 63-164281[U] |

[51] Int. Cl.[4] ..... B28B 13/00

[52] U.S. Cl. ..... 81/57.32; 81/52; 81/57.16; 81/57.34; 173/164

[58] Field of Search ..... 81/54, 57.16, 57.32, 81/57.34, 57.39, 52; 173/164

[56] References Cited

U.S. PATENT DOCUMENTS

| | | | |
|---|---|---|---|
| 443,312 | 12/1890 | Bode | 81/52 |
| 1,401,405 | 12/1921 | Hole | 173/164 |
| 1,476,341 | 12/1923 | Le Bus et al. | 81/57.32 |
| 1,634,602 | 7/1927 | Wilson | 81/57.32 |
| 2,450,967 | 10/1948 | Keiser | 81/57.32 |
| 3,752,061 | 8/1973 | Ballard | 81/57.17 X |
| 3,880,024 | 4/1975 | Asada | 81/57.34 |
| 4,345,493 | 8/1982 | Rassieur | 81/57.34 |
| 4,732,061 | 3/1988 | Dinsdale | 81/57.34 |

FOREIGN PATENT DOCUMENTS

| | | | |
|---|---|---|---|
| 2511353 | 9/1975 | Fed. Rep. of Germany | 81/57.16 |

*Primary Examiner*—James G. Smith

[57] ABSTRACT

An oscillating drive apparatus for working tools which enables a large-diameter pipe to be readily and efficiently turned, cut or threaded without the need for a large working area. The apparatus comprises a casing body, a vise for holding a pipe, the vise being provided at the forward end of the casing body, a motor provided inside the casing body, a speed reducing gear train provided inside the casing body, and an oscillating arm for driving a working tool, the oscillating arm being provided on one side of the casing body so as to be oscillated by the final output shaft of the speed reducing gear train through an oscillating drive mechanism. Also disclosed is a working apparatus for pipes wherein a shaft is provided on the distal end portion of the oscillating arm of the oscillating drive apparatus in such a manner as to extend parallel to a pipe held by the vise and a wrench or cutter member is attached to the shaft.

12 Claims, 7 Drawing Sheets

OSCILLATING DRIVE APPARATUS FOR WORKING TOOL AND WORKING APPARATUS USING THE SAME

BACKGROUND OF THE INVENTION

1. Field of the Invention

The present invention relates to an oscillating drive apparatus for automatically activating working tools such as a pipe wrench, pipe threading machine, pipe cutter and so forth. The present invention also pertains to a working apparatus equipped with such a working tool.

2. Description of the Prior Art

In a series of plumbing operations consisting of cutting a pipe, threading an end portion of the pipe and thread engagement of the pipe with a pipe joint, various kinds of manually operated working tools such as a pipe cutter, pipe threading machine and pipe wrench are used. However, the working tools that are used for pipes with large diameters have a large size and include a long handle, so a considerably large working space is required. Such large-sized working tools are also heavy and a great deal of labor is therefore expended in conducting plumbing work with them. Thus, the prior art suffers from poor working efficiency and various other problems.

SUMMARY OF THE INVENTION

In view of the above-described problems of the prior art, it is one object of the present invention to provide an oscillating drive apparatus for working tools which enables plumbing of large-diameter piping to be readily and efficiently conducted without the need for a large working space. and which is capable of driving various kinds of working tools by itself.

It is another object of the present invention to provide an oscillating drive apparatus for working tools which enables improvements in the working efficiency of an operation conducted at an elevated position while also attaining the above-described object.

It is still another object of the present invention to provide a working apparatus for pipes which enables a large-diameter pipe to be readily and efficiently turned, cut or threaded without the need for a large working space.

It is a further object of the presnt invention to provide a working apparatus for turning a pipe which enables a large-diameter pipe not only to be automatically turned but also to be accurately turned to a predetermined position.

To these ends, the present invention provides an oscillating drive apparatus for working tools comprising: a casing body; a vise for holding a pipe, the vise being provided at the forward end of the casing body; a motor provided insise the casing body; a speed reducing gear train provided inside the casing body; and an oscillating arm for driving a working tool, the oscillating arm being provided on one side of the casing body so as to be oscillated by the final output shaft of the speed reducing gear train through an oscillating drive mechanism.

According to another of its aspects, the present invention provides an oscillating drive apparatus for working tools wherein the vise is formed as a member which is separate from the casing body and is detachably fixed to the casing body by fixing means.

According to another of its aspects, the present invention provides a working apparatus for turning pipes wherein a shaft is provided on the distal end portion of the oscillating arm of the oscillating drive apparatus in such a manner as to extend parallel to a pipe held by the vise and a wrench member is attached to the shaft through a grip thereof.

According to another of its aspects, the present invention provides a working apparatus for machining pipes wherein a shaft is provided on the distal end portion of the oscillating arm of the oscillating drive apparatus in such a manner as to extend parallel to a pipe held by the vise and a cutter member is attached to the shaft.

According to another aspect of the present invention, an output control mechanism capable of adjusting the output level of the motor is incorporated in the casing body of the above-described working apparatus.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which.

DESCRIPTION OF THE PREFERRED EMBODIMENTS

Embodiments of the present invention will be described hereinunder in detail with reference to the accompanying drawings.

Figure 1:
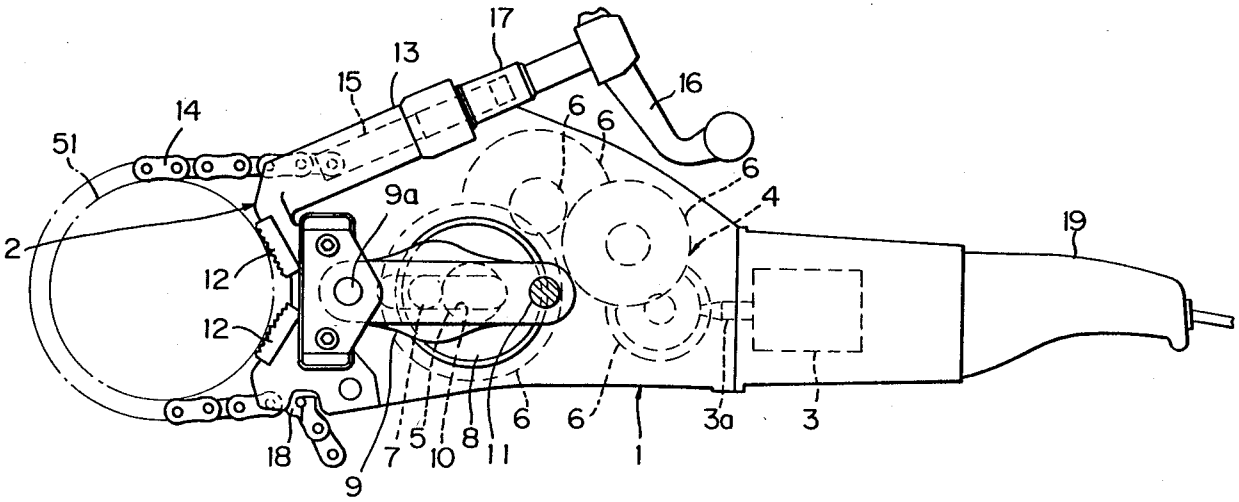
FIG. 1 is a side view of one embodiment of the oscillating drive apparatus according to the present invention.
Figure 2:
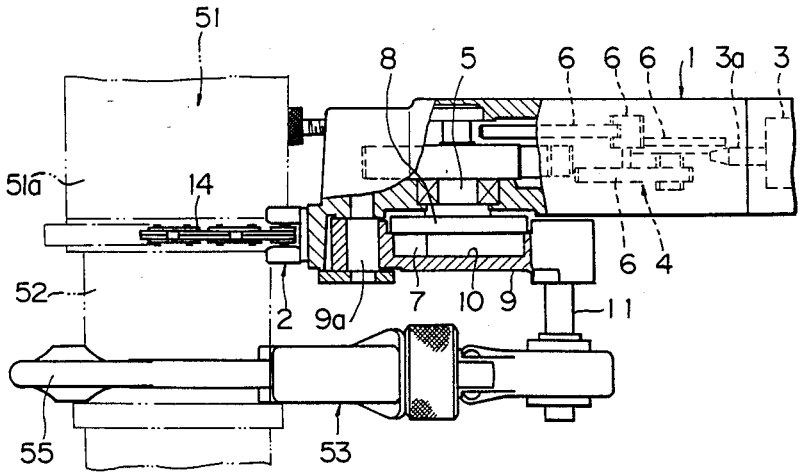
FIG. 2 is a partially cutaway plan view of the apparatus shown in FIG. 1 which is equipped with a working tool consisting of a pipe wrench.
Figure 3:
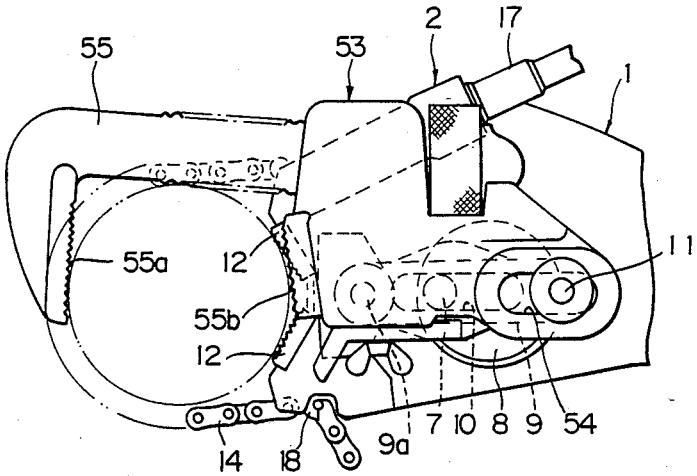
FIG. 3 is a side view of the apparatus shown in FIG. 2.

Referring first to FIGS. 1, 2 and 3, which show in combination one embodiment of the oscillating drive apparatus according to the present invention, the reference numberal 1 denotes a casing body having a vise 2 provided at the forward end thereof. Inside the casing body 1 are accommodated a motor 3 and a speed reducing gear train 4 which is driven through a rotary shaft 3a of the motor 3 in such a manner that the distal end of the final output shaft 5 of the gear train 4 projects from the center of one side of the casing body 1. The speed reducing gear train 4 is comprised of a plurality of gears 6. A disk 8 which has an eccentric pin 7 projecting therefrom is provided on the distal end of the final output shaft 5.

The reference numeral 9 denotes an oscillating arm for oscillating a working tool such as a pipe wrench, pipe cutter, etc. The oscillating arm 9 is pivotally supported at the proximal end portion thereof on the side surface of the forward end of the casing body 1 through a pin 9a. The intermediate portion of the oscillating arm 9 is provided with a slot 10 which is slidably fitted with the eccentric pin 7. The oscillating arm 9 further has a shaft 11 for driving a working tool, the shaft 11 projecting from the distal end portion thereof. Accordingly, as the disk 8 rotates, the eccentric pin 8 slides within the slot 10 while activating the oscillating arm 9 to oscillate about the pin 9a, thus causing the shaft 11 to oscillate up and down. It should be noted that the vise 2 has a pair of sawtoothed pipe holding members 12 which are attached to the front side of the casing body 1 such as to face each other vertically in the shape of a V when viewed from the side. In addition, a tubular member 13 is obliquely provided on the upper side of the casing body 1. A member having an internal thread 17 is rotatably attached to the upper end of the tubular member 13. The member 17 is adapted to pull up a threaded rod 15 having one end of a chain 14 pivotally attached to the lower end thereof. Further, a hook 18 for retaining the other end portion of the chain 14 is provided on the lower side of the casing body 1. In operation, a pipe is encircled by the chain 14 and the free end portion of the chain 14 is engaged with the hook 18 and the handle 16 is then turned. In consequence, the chain 14 tightly clamps the pipe, so that the pipe and the apparatus of this embodiment are firmly secured to each other. The reference numeral 19 denotes a grip incorporating a switch, the grip 19 being provided contiguously with the rear end portion of the casing body 1. It should be noted that the chain vise 2 employed in this embodiment is not necessarily exclusive and other types of vise may also be employed.

The method of using the apparatus of the above-described embodiment will next be explained by way of one example in which the apparatus is used to screw a pipe 52 into a socket portion 51a of a pipe joint 51, as shown in FIGS. 2 and 3. First, the apparatus of this embodiment is secured to the socket portion 51a of the pipe joint 51 by means of the vise 2 provided at the forward end of the casing body 1 in the manner described above. Next, the proximal end portion of a pipe wrench 53 is attached to the working tool supporting shaft 11 provided on the side of the distal end portion of the oscillating arm 9 in a manner which will be described later, and the upper jaw 55 of the pipe wrench 53 is adjusted so that the pipe 52 is gripped between the teeth 55a of the upper jaw 55 and the teeth 55b provided on the body of the pipe wrench 53. After this preliminary operation has been completed, the motor 3 accommodated in the rear portion of the casing body 1 is caused to rotate. In consequence, the rotation of the rotary shaft 3a of the motor 3 is transmitted to the final output shaft 5 after the speed thereof has been reduced through the speed reducing gear train 4, thus causing the eccentric pin 7 projecting from the center of the side surface of the casing body 1 to revolve together with the disk 8. Since the eccentric pin 7 is slidably fitted in the slot 10 provided in the oscillating arm 9 pivotally supported at the proximal end portion thereof on the side surfacwe of the forward end portion of the casing body 1, the eccentric pin 7 causes the oscillating arm 9 to oscillate up and down. As a result, the pipe wrench 53 that is attached to the working tool supporting shaft 11 provided on the side surface of the distal end portion of the oscillating arm 9 oscillates up and down about the pipe 52, thus causing the pipe 52 to be automatically screwed into the socket portion 51a of the pipe joint 51 (it should be noted that, when turned in the tightening direction, the pipe wrench 53 grips the pipe 52, but when turned in the reverse direction, it slides on the pipe 52).

Thus, employment of the apparatus of this embodiment enables a working tool to be oscillated up and down with strong force and eliminates the need for a long handle as in the case of a manually operated apparatus. It is therefore possible to conduct plumbing of large-diameter pipes utilizing a relatively narrow space. If the apparatus is employed for a task to be conducted at an elevated location, it is possible to prevent any risk of a working tool accidentally being dropped. It should be noted that, although in this embodiment a pipe wrench is exemplified as the working tool, it is of course also possible to drive other oscillating working tools such as a pipe cutter, pipe threading machine, etc. Accordingly, it is possible to conduct various kinds of work with considerable efficiency simply by exchanging one working tool for another.

Figure 4:
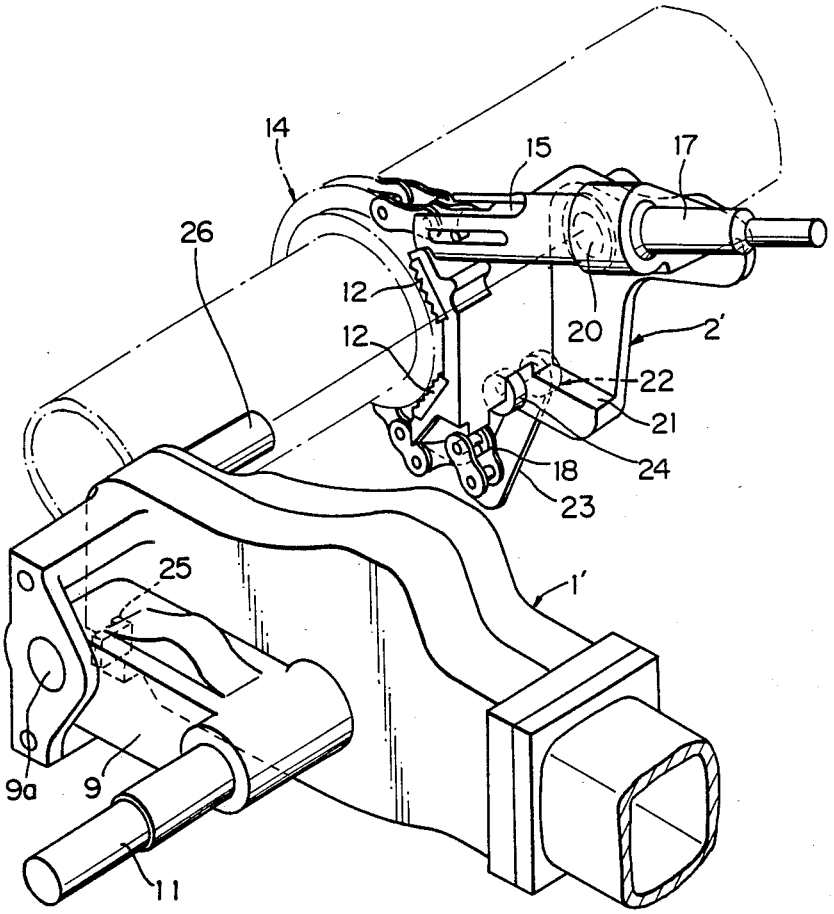
FIG. 4 is a perspective view of another embodiment of the oscillating drive apparatus according to the present invention.
Figure 5:
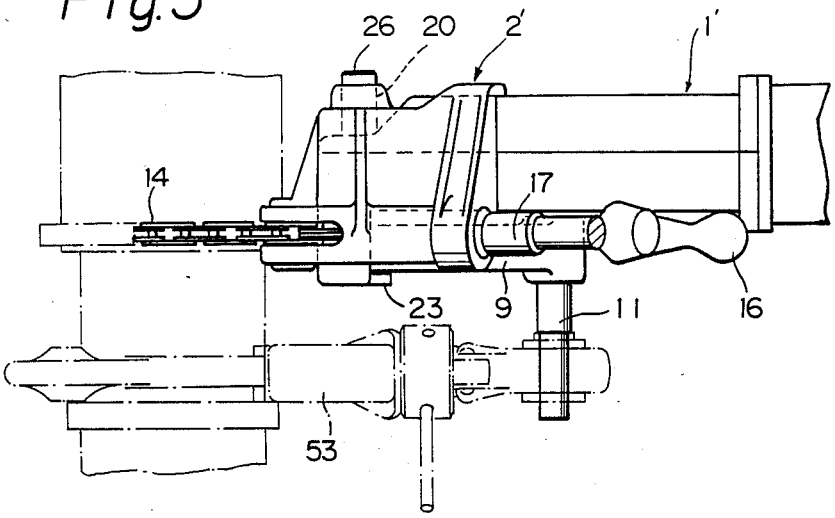
FIG. 5 is a partially cutaway plan view of the apparatus shown in FIG. 4 which is equipped with a working tool consisting of a pipe wrench.
Figure 6:
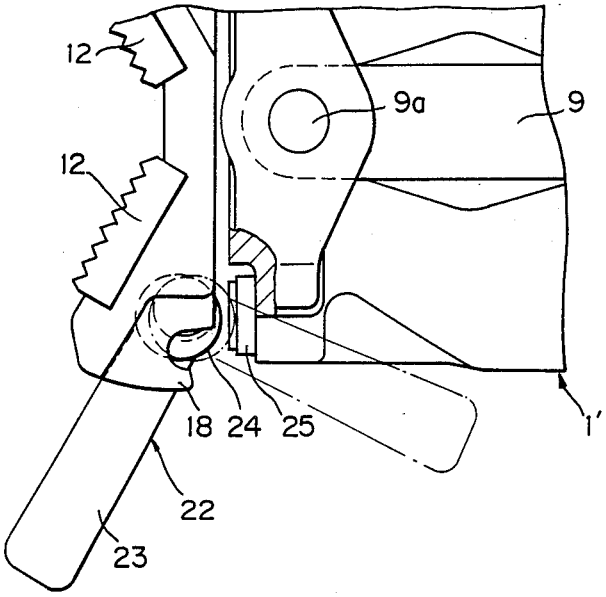
FIG. 6 is an enlarged side view showing one example of the clamp mechanism for fixing the vise to the casing body.

FIGS. 4 to 6 show a combination another embodiment of the oscillating drive apparatus according to the present invention. In these figures, reference numerals which are the same as those in FIGS. 1 to 3 denote the same or like constituent elements.

This embodiment differs from the foregoing embodiment in that the vise is arranged in the form of a member which is separate from the casing body and this vise is detachably fixed to the casing body by means of a fixing mechanism.

Consequently, a shaft 26 for attaching the casing body 1' to the vise 2' is provided on the reverse side of the casing body 1', as is clearly shown in FIG. 4.

The vise 2' is provided with a bore 20 for receiving the shaft 26 provided on the casing body 1', a retaining step portion 21 and a fixing mechanism 22. As most clearly shown in FIG. 6, the fixing mechanism 22 comprises a lever 23 and eccentric rollers 24 which are attached to the proximal portion of the lever 23. If the lever 23 is pulled by hand with the shaft 26 of the casing body 1' inserted into the bore 20 in the vise 2', the eccentric rollers 24 are firmly engaged with an L-shaped projection 25 provided on the front side of the casing body 1', thus enabling the casing body 1' to be clamped to the vise 2'. It should be noted that the fixing mechanism 22 may be arranged using any suitable means such as screws in place of the eccentric rollers 24.

To conduct, for example, a pipe tightening operation, using the oscillating drive apparatus of this embodiment in the arrangement described above, the vise 2' alone is first secured to one pipe by use of the chain 14 of the vise 2', as shown in FIG. 4. Then, the shaft 26 of the casing body 1 is inserted into the bore 20 in the vise 2' and the lever 23 of the fixing mechanism 22 is pulled to clamp the casing body 1' to the vise 2'. Next, an oscillating working tool 53, for example, a pipe wrench, is attached to the shaft 11 projecting sideward from the distal end portion of the oscillating arm 9 provided on the casing body 1' and, after the distal end portion of the working tool 53 has been engaged with the other pipe, the motor 3 is rotated. As a result, the oscillating arm 9 oscillates up and down and the working tool 53 also oscillates up and down about the pipe, together with the oscillating arm 9, thus enabling a pipe tightening operation to be conducted automatically.

According to this embodiment, it is possible to first attach the vise 2' to a pipe and then attach the casing body 1' to the vise 2' since the vise 2' and the casing body 1' are separable from each other. Hence it is possible to reduce the handling weight to about half that in the case of the previous embodiment wherein the casing body and the vise are formed integral with each other as one unit. It is accordingly possible to enhance working efficiency even when a task is conducted at an elevated location.

Figure 7:
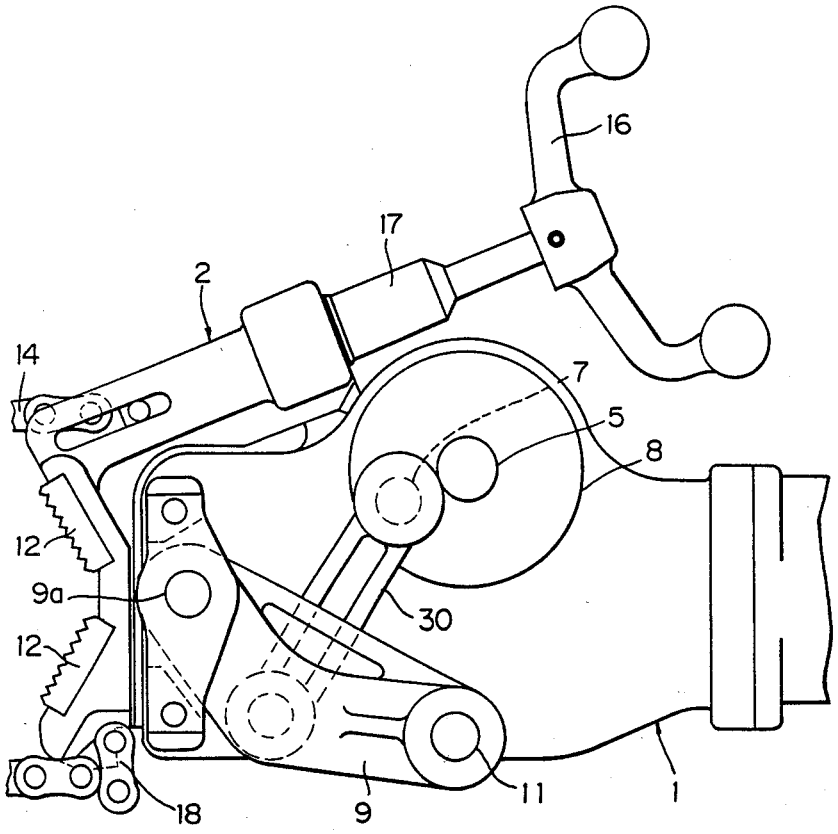
FIG. 7 is a side view showing another example of the oscillating arm drive mechanism.
Figure 8:
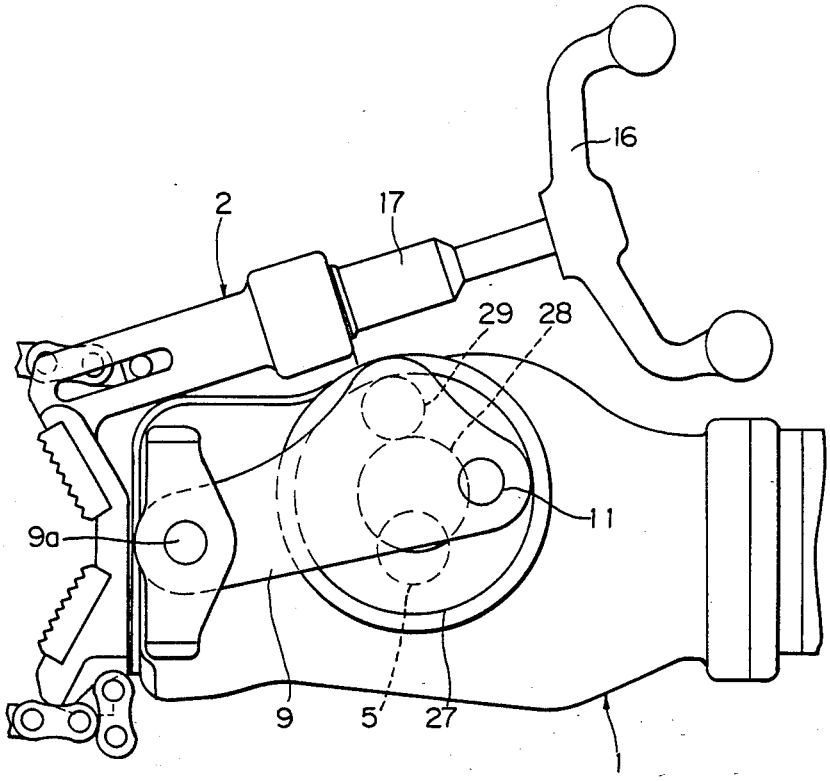
FIG. 8 is a side view showing still another example of the oscillating arm drive mechanism.

FIGS. 7 and 8 show other embodiments of the present invention which are respectively different from the foregoing embodiments in the arrangement of the oscillating drive mechanism for oscillating the oscillating arm.

In the embodiment shown in FIG. 7, the rotary disk 8 and the oscillating arm 9 are coupled together through a crank lever 30 which serves as a connecting rod and is pivotally attached at one end thereof to the eccentric pin 7 and at the other end thereof to the oscillating arm 9. Thus, as the rotary disk 8 rotates, the oscillating arm 9 oscillates about the pin **9*a* through the crank lever 30**.

In the embodiment shown in FIG. 8, an eccentric rotary cam 27 which rotates about the final output shaft 5 is provided on one side surface of the casing body 1. The cam 27 has an annular cam groove 28 which is engaged with a cam follower 29 provided on the reverse surface of the oscillating arm 9. Thus, as the rotary cam 27 rotates about the shaft 5, the oscillating arm 9 oscillates about the pin **9*a***. Since the arrangements of the other portion of this embodiment are the same as those of the foregoing embodiments, the corresponding portions or members are denoted by the same reference numerals and description thereof is omitted here.

The embodiment shown in FIG. 7 has the advantage that it is possible to obtain a considerably large angle of oscillation for the oscillating arm 9 by the use of a crank mechanism, whereas the embodiment shown in FIG. 8 has the advantage that it is possible to oscillate the oscillating arm 9 strongly and smoothly by means of the rotary cam 27.

It should be noted that, in the embodiments shown in FIGS. 7 and 8 also, it is possible to arrange the vise 2 in the form of a member which is separate from the casing body 1, as in the case of the embodiment shown in FIGS. 4 to 6.

Figure 9:
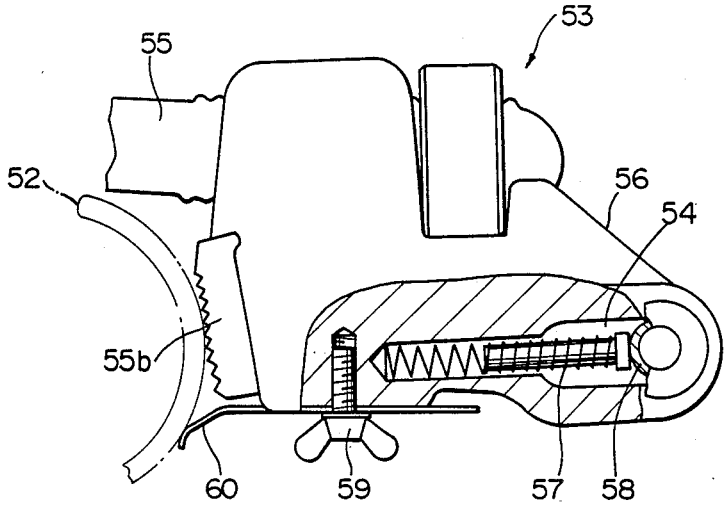
FIG. 9 is a partially cutaway side view showing one example of a pipe wrench used in the working apparatus for turning pipes in accordance with the present invention.

FIG. 9 shows in detail the structure of a pipe wrench 53 that may be attached to the shaft 11 of the oscillating arm 9.

As is illustrated, the pipe wrench 53 includes a wrench body 56 having a slot 54 provided therein and a bush 58 provided inside the slot 54, the bush 58 being biased rearward by the action of a spring 57. A support plate 60 is attached to the forward portion o the lower surface of the wrench body 56 by means of a thumbscrew 59 in such a manner that the position of the support plate 60 is adjustable. The pipe wrench 53 is attached to the casing body 1 through the bush 58 which is fitted on the shaft 11, as shown in FIGS. 2 and 3, and at this time, the whole of the pipe wrench 53 is pushed forward by means of the resilient force from the spring 57, so that the support plate 60 is constantly pressed against the side surface of the pipe 52. Thus, since the pipe wrench 53 is constantly pressed against the pipe 52 by means of the resilient force from the spring 57, thereis no fear of the pipe wrench 53 undesirably disengaging from the pipe 52.

In the case where the pipe wrench 53 grips a pipe from the lower side thereof or the pipe wrench 53 grips a vertical pipe sidewardly, the support plate 60 prevents the pipe wrench 53 from disengaging from the pipe and it is therefore possible to turn the pipe in the same way as in the case where the pipe wrench 53 grips it from the upper side thereof.

Figure 10:
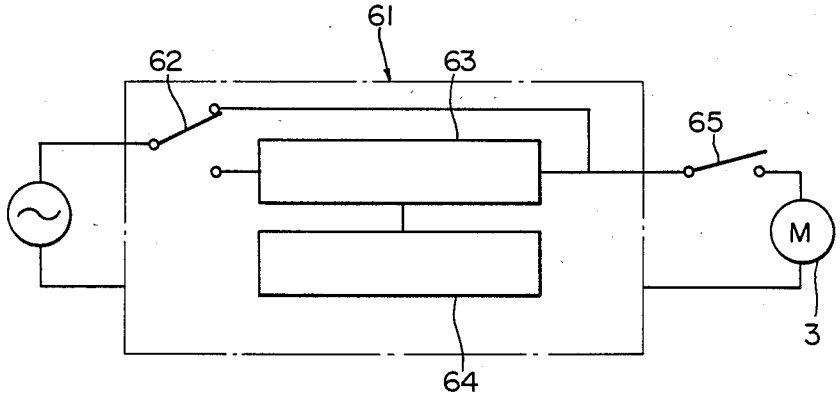
FIG. 10 is a circuit diagram showing one example of the output control mechanism incorporated in the working apparatus for turning pipes in accordance with the present invention.

FIG. 10 shows an output control mechanism which is incorporated in the apparatus according to the present invention. The output control mechanism controls the level of output of the motor 3 appropriately so as to prevent over-tightening or insufficient tightening of a pipe.

More specifically, the output control mechanism 61 shown in FIG. 10 is incorporated in the casing body 1 of the apparatus according to the present invention. The output control mechanism 61 includes a switch 62, an output control circuit 63, an output detecting and displaying circuit 64 and an inching control switch 65. The output control circuit 63 has control setting knobs which make it possible to control the level of output of the motor 3 by controlling the current and voltage of power supplied to the motor 3 and the duration of supply of the power. The output detecting and displaying circuit 64 detects and display values set in the output control circuit 63. It will be convenient to provide several different kinds of pilot lamps in correspondence with the sizes of pipes having different diameters.

In the early stage of an operation of tightening a pipe, the switch 62 of the output control mechanism 61 is set in the position shown in FIG. 10 and the inching control switch 64 is turned on. In consequence, the motor 3 rotates at full power, thereby enabling the pipe to be turned at high speed. However, when the tightening operation is near its final stage, the switch 62 is changed over to the position for the output control circuit 63. In consequence, the output of the motor 3 is lowered to a level previously set in accordance with the diameter of the pipe concerned, thus enabling the level of tightening force to be adjusted appropriately. Further, since the conditions of output control effected by the output control circuit 63 are displayed through pilot lamps or other similar means by the output detecting and displaying circuit 64, it is possible to confirm that the level of tightening force has been set at a value appropriate for the diameter of each individual pipe. In addition, in the final stage of the tightening operation, it is possible to turn the pipe to a predetermined position with high accuracy by manually turning on and off the inching control switch 65 and it is therefore possible to prevent over-tightening or insufficient tightening of the pipe.

It should be noted that, if the output control mechanism 61 is incorporated at an intermediate portion of the power supply cable, it is possible to watch the pipe turning condition and the output control conditions at the same time.

Although the present invention has been described through specific terms, it should be noted here that the described embodiments are not exclusive and that various changes and modifications may be imparted thereto without departing from the scope of the invention which is limited solely by the appended claims.

What is claimed is:

1. An oscillating drive apparatus for a working tool comprising:

a casing body;

a vise for holding a pipe, said vise being provided at the forward end of said casing body;

a motor provided inside said casing body;

a speed reducing gear train provided inside said casing body; and an oscillating arm for driving a working tool, said oscillating arm being provided on one side of said casing body so as to be oscillated by a final output shaft of said speed reducing gear train through an oscillating drive mechanism.

2. An oscillating drive apparatus according to claim 1, wherein said oscillating drive mechanism comprises a rotary disk rigidly secured to said final output shaft, an eccentric pin provided on said rotary disk, and a slot provided in said oscillating arm, said slot being engaged with said eccentric pin.

3. An oscillating drive apparatus according to claim 1, wherein said oscillating drive mechanism comprises a rotary disk rigidly secured to said final output shaft, an eccentric pin provided on said rotary disk, and a connecting rod which connects together said eccentric pin and said oscillating arm.

4. An oscillating drive apparatus according to claim 1, wherein said oscillating drive mechanism comprises a rotary cam having a cam groove which is rigidly secured to said final output shaft and a cam follower provided on said oscillating arm, said cam follower being engaged with said cam groove.

5. An oscillating drive apparatus according to claim 1, wherein said vise is formed integral with said casing body.

6. An oscillating drive apparatus according to claim 1, wherein said vise is formed as a member which is separate from said casing body and is detachably fixed to said casing body by fixing means.

7. A working apparatus for turning a pipe comprising:

a casing body;

a vise for holding a pipe, said vise being provided at the forward end of said casing body;

a motor provided inside said casing body;

a speed reducing gear train provided inside said casing body;

an oscillating arm for driving a working tool, said oscillating arm being provided on one side of said casing body so as to be oscillated by a final output shaft of said speed reducing gear train through an oscillating drive mechanism;

a shaft provided on the distal end portion of said oscillating arm in such a manner as to extend parallel to the pipe held by said vise; and a wrench member attached to said shaft through a grip thereof.

8. A working apparatus according to claim 7, wherein an output control mechanism capable of adjusting the level of output of said motor is incorporated in said casing body.

9. A working apparatus according to claim 8, wherein said output control mechanism is also capable of inching control of said motor.

10. A working apparatus for machining a pipe comprising:

a casing body;

a vise for holding a pipe, said vise being provided at the forward end of said casing body;

a motor provided inside said casing body;

a speed reducing gear train provided inside said casing body;

an oscillating arm for driving a working tool, said oscillating arm being provided on one side of said casing body so as to be oscillated by a final output shaft of said speed reducing gear train through an oscillating drive mechanism;

a shaft provided on the distal end portion of said oscillating arm in such a manner as to extend parallel to the pipe held by said vise; and a cutter member attached to said shaft.

11. A working apparatus according to claim 10, wherein said cutter member is a pipe cutter.

12. A working apparatus according to claim 10, wherein said cutter member is a pipe threading machine.

* * * * *